United States Patent [19]

Levings, Jr.

[11] 4,285,094

[45] Aug. 25, 1981

[54] DOOR CLOSING APPARATUS

[76] Inventor: Nelson Levings, Jr., 8101 Willow Dr., Palos Hills, Ill. 60465

[21] Appl. No.: 932,773

[22] Filed: Aug. 11, 1978

[51] Int. Cl.[3] ..... E05F 3/10

[52] U.S. Cl. ..... 16/52; 16/58; 16/66; 16/DIG. 9; 16/DIG. 21; 137/533.11

[58] Field of Search ..... 16/49, 51, 52, 66, 58, 16/139, 140, 142, 145, 59, DIG. 9, DIG. 10, DIG. 17, DIG. 21, DIG. 39; 49/137; 188/297, 318; 137/533.11

[56] References Cited

U.S. PATENT DOCUMENTS

| | | | |
|---|---|---|---|
| 2,476,434 | 7/1949 | Spang | 137/533.11 X |
| 2,723,416 | 11/1955 | Schlage | 16/52 |
| 2,772,439 | 12/1956 | Flint | 16/49 |
| 2,809,659 | 10/1957 | Gillespie et al. | 137/533.11 X |
| 2,829,395 | 4/1958 | Schlage | 16/52 |
| 2,942,291 | 6/1960 | Flint | 16/49 |
| 3,028,619 | 4/1962 | Schlage et al. | 16/49 |
| 3,182,348 | 5/1965 | Wells | 16/49 |
| 3,714,677 | 2/1973 | Schmid | 16/52 X |
| 3,877,108 | 4/1975 | Del Fiacco | 16/49 |
| 4,197,875 | 4/1980 | Schieferstein et al. | 137/533.11 |

FOREIGN PATENT DOCUMENTS

| | | | |
|---|---|---|---|
| 2351333 | 12/1977 | France | 137/533.11 |
| 905683 | 9/1962 | United Kingdom | 137/533.11 |

*Primary Examiner*—C. J. Husar

*Assistant Examiner*—Moshe I. Cohen

*Attorney, Agent, or Firm*—Trexler, Bushnell & Wolters, Ltd.

[57] ABSTRACT

A door closing apparatus includes a housing member defining a cylinder for receiving a reciprocable piston member. The housing also defines an opening for receiving a rotatable pinion meshing with teeth on the piston. The apparatus also includes a linkage assembly for operatively connecting the door closing apparatus between a door and a door frame. This linkage includes a drive member for rotating the pinion bidirectionally in response to respective opening and closing of the door. An adjustable biasing assembly is provided for urging the piston in a predetermined direction within the housing cylinder, and the housing is sealed to receive a predetermined amount of oil or other fluid for hydraulically regulating the piston motion. To achieve this regulation, the housing includes an arrangement of interconnected fluid carrying channels and one or more valve members are mounted in cooperation with the channels. Advantageously the valve members cooperate with the channels to provide an adjustable variable control over the reciprocal movement of the piston, as, for example, to adjust the close rate and latch rate of the associated door. In a preferred embodiment, a hold open assembly is provided and comprises a holding member joined for rotation with the pinion and a stop member for releasably engaging the holding member to hold the door open.

13 Claims, 18 Drawing Figures

DOOR CLOSING APPARATUS

BACKGROUND OF THE INVENTION

This invention relates generally to closer apparatus, and more particularly to a new and improved door closer including means for selectively and independently varying opening force, back check force, latching rate, and closing rate of a door.

Door closers known in the prior art range from relatively simple spring loaded pneumatic tube structures to relatively complex hydraulic or pneumatic devices. In many applications, it is desirable to provide a door closer capable of some adjustment with respect to several facets of its operation. Specifically, it is desirable to provide for an adjustment of the amount of resistance provided by the door closer apparatus against opening of the associated door. In this respect, a relatively wide range of adjustment is especially desirable, so that the door closer is useable in conjunction with a considerable range of door sizes and weights. A further desirable adjustment is in the back check force provided, that is, some additional resistance towards the end of the opening motion of the door to avoid damage as, for example, to the hinges, to the door frame or to the door itself due to excessive force being applied during opening. Yet another desirable adjustment is in the closing rate which similarly renders the closer useable in conjunction with a considerable range of door sizes and weights, and also provides a desired rate of closing for a given application. Still another desirable adjustment is in the latch rate of the closer device. By this is meant the application of some additional increment of force toward the end of the closing motion of the door to insure full closure and latching of the associated door while preventing "slamming" which may damage the door or associated parts. It will be recognized that provision for independently adjusting a door closer for each of these areas of operation renders the closer device useable over a broad range of applications.

Yet another desirable feature in a door closer is an adjustable hold open device, for holding the associated door open at a desired position in the travel thereof. Furthermore, some adjustment of the amount of force applied by the hold open device to hold the door open, will accommodate doors of different weights, and also variable loads on doors, such as wind or the like.

Door closers providing some or all of the foregoing adjustments are known in the prior art. However, such door closers have heretofore generally presented at least two significant and related problems or limitations. Specifically, the provision of the foregoing adjustable functions has heretofore required a relatively large and complex apparatus comprising numerous parts. Consequently, many of these prior art door closers have proven unusable in applications where limited space is available. Moreover, such prior art door closer devices have heretofore been relatively difficult to fabricate and assemble, requiring many precision machined parts and therefore leading to increases in labor and expense, often to the point of excess. Such cost factors tend to further limit the desirability of such door closers in an increasingly cost-conscious marketplace.

OBJECTS AND SUMMARY OF THE INVENTION

Accordingly, it is an object of this invention to provide a new and improved door closer apparatus which includes provision for independent adjustment of opening force back check force, closing rate and latching rate or force.

Another object of this invention is to provide a new and improved door closer apparatus in accordance with the foregoing object whose overall exterior dimensions are minimized so as to permit mounting the apparatus in many applications where limited mounting space is available.

Yet another object of this invention is to provide a door closer in accordance with the foregoing objects which comprises relatively simple and inexpensive parts, and requires relatively few operations in its manufacture and assembly, thus minimizing the cost of the finished door closer.

Still another object of this invention is to provide a door closer apparatus in accordance with the foregoing objects suitable for use over a considerable variety of doors of different sizes and weights.

Still another object of this invention is to provide a door closer apparatus in accordance with the foregoing objects further including provision for holding an associated door open at a desired point in its travel, and adjusting the force applied in holding the door open to accommodate a broad range of doors of different weights.

Other objects, features and advantages of this invention will be more readily appreciated upon a consideration of the following detailed description, together with the accompanying drawings, wherein like reference numerals throughout designate like elements and components.

DETAILED DESCRIPTION OF THE ILLUSTRATED EMBODIMENT

Figures 1, 2, 3, 4, 5, 6:
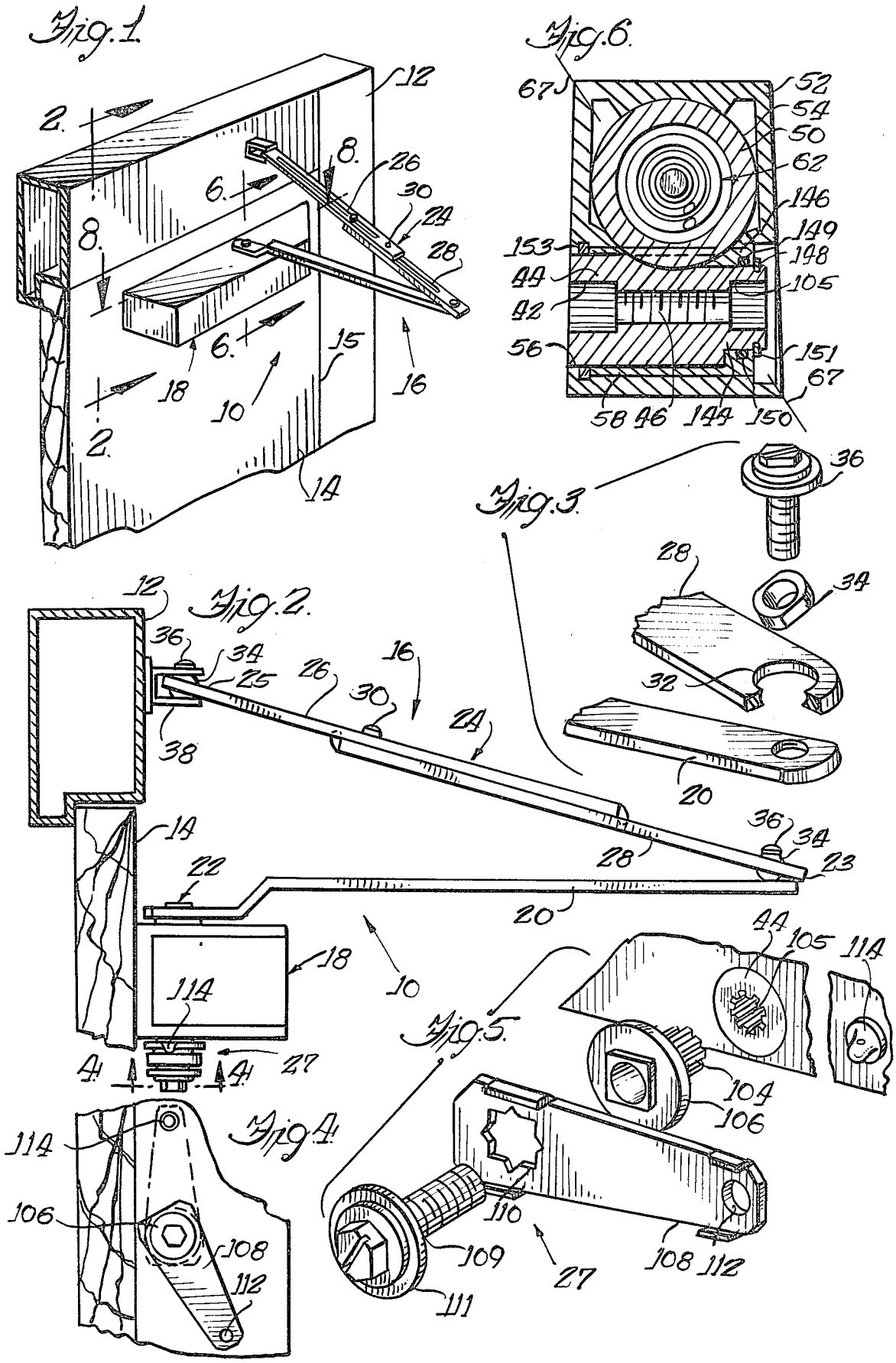
FIG. 1 is a perspective view, partially broken away, of a door closer apparatus according to this invention in conjunction with a door and door frame.
FIG. 2 is an enlarged view taken generally along the line 2—2 of FIG. 1.
FIG. 3 is an enlarged perspective view, partially in section, of a portion of FIG. 2.
FIG. 4 is an enlarged view taken generally along the line 4—4 of FIG. 2.
FIG. 5 is an exploded perspective view illustrating the cooperation of selected parts of FIG. 4.
FIG. 6 is an enlarged view taken generally along the line 6—6 of FIG. 1.

Referring now in detail to the drawings, and initially to FIGS. 1 and 2 there is seen a door closer apparatus, designated generally 10, constructed in accordance with this invention, and mounted in conjunction with a door frame 12 and a door 14 mounted at an edge 15 for hinged movement with respect to the frame 12. Broadly speaking, the door closer apparatus 10 includes a linkage assembly designated generally 16 and a closer drive assembly designated generally 18. As illustrated in FIGS. 1 and 2, the closer drive assembly 18 is mounted on the door 14 while the linkage assembly 16 is mounted between the closer assembly 18 and the door frame 12. It will be understood however, that the door closer 10 may alternatively be utilized with the closer drive assembly 18 mounted on the door frame 12 and the linkage assembly 16 mounted between the closer assembly 18 and the door 14. In either instance, it will be recognized that the linkage assembly 16 acts generally to transmit forces developed during the opening and closing of the door 14, between the stationary frame 12 and the hinged, moveable door 14 via the closer drive assembly 18. As will be explained in additional detail hereinbelow, the motion of the door 14 with respect to the frame 12 in response to force applied to the door is controlled via the linkage assembly 16, and by the closer drive assembly 18.

As best seen in FIGS. 1 and 2, the linkage assembly 16 includes a first arm or linkage member 20 connected by a drive shaft or drive member 22 to the closer drive assembly 18, as will be described later. An opposite end of the arm 20 is pivotally connected with an end portion 23 of a second arm or linkage member 24 which comprises a pair of elongate, longitudinally slotted members 26 and 28 joined by a suitable fastener 30. The fastener 30 is arranged in the slots of the members 26 and 28 to alternatively release and engage the members 26 and 28, for selectively permitting sliding, longitudinal motion therebetween, for setting the overall length of the arm or linkage 24. An end portion 25 of the arm 24 is pivotally mounted at the door frame 12. A hold-open assembly, designated 27 is also seen in FIG. 2, and will be described in detail later.

The pivotal mounting arrangements at the end portions 23 and 25 of the arm 24 are best seen in FIG. 3. Specifically, the ends 23 and 25 are provided with similar mounting apertures 32 therethrough, defined by an annular interior surface comprising a segment of a sphere. In accordance with a feature of the invention, a bearing member 34 comprises a generally flat member having a central opening therethrough, and having one pair of flatted opposed sides and another pair of spherically shaped opposed sides, which latter pair of sides are generally of complimentary spherical configuration to that of the apertures 32. Thus, the bearing 34 may be turned at an angle with respect to the plane of aperture 32, to be inserted therein and then rotated slightly so as to engage the spherical outer surfaces thereof with the spherical inner surfaces of the aperture 32. Thereupon, a suitable fastener 36 is inserted through the bearing 34 to engage the arm 20, thus holding the arms 20 and 24 in pivotal engagement while allowing some degree of relative rotation about three axes substantially in the nature of a ball joint. In similar fashion, a bracket 38, affixed to the door frame 12, is pivotally engaged with the arm 24. In accordance with a preferred embodiment of the invention, the bearing members 34 are constructed of a sintered powdered metal material by known techniques, thereby economically providing a smooth, durable, low friction bearing surface.

Figures 7, 8, 9:
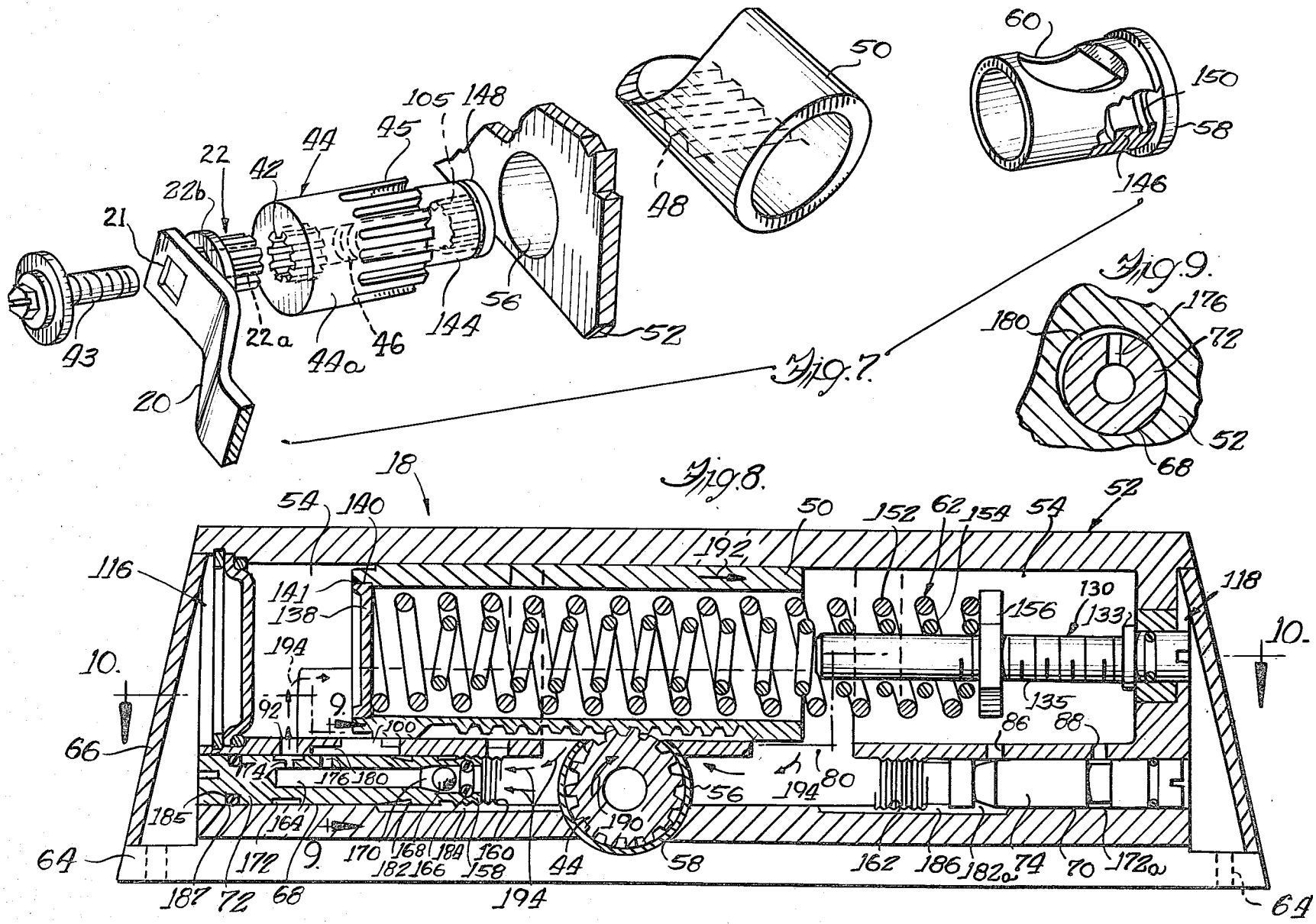
FIG. 7 is an exploded perspective view, illustrating the cooperation of selected parts of the invention.
FIG. 8 is an enlarged view taken generally along the line 8—8 of FIG. 1.
FIG. 9 is a section taken generally along the line 9—9 of FIG. 8.

As best seen in FIG. 7, the driveshaft or drive member 22 preferably comprises a splined end and a squared end for engaging a complimentary internally splined central socket 42 in a pinion member 44 of the closer drive assembly 18 and a square socket 21 in the arm 20, respectively. A spacer portion 22*b* separates these two shaft ends. A suitable fastener such as a screw 43 extends through a central opening 22*a* of the drive member 22 to engage an internally threaded opening 46 axially inwardly of and coaxial with the socket 42, in the pinion 44. Consequently, the drive member 22 rotates in unison with the pinion 44. Thus, the hinged movement of the door 14 is converted to rotary motion of the pinion 44 and vice-versa. The pinion 44 includes a plurality of circumferentially spaced teeth 45 which engage complimentary teeth 48 of a piston member 50, to convert the rotary motion of the pinion 44 into reciprocal motion of the piston 50.

As best seen in FIG. 8, the closer drive assembly 18 comprises a housing designated generally 52 which defines an internal, elongate cylinder 54 to receive the piston 50 for reciprocal motion. A cylindrical bore 56 is defined in the housing 52 substantially perpendicular with and below the cylinder 54 as viewed in FIG. 8, such that a minor fractional edge portion of the cylinder 54 and bore 56 interconnect to allow the engagement of the teeth 45 with the teeth 48. A bushing 58 is provided as best seen in FIG. 7 for rotatably receiving the pinion 44 within the bore 56. The bushing 58 includes a window or aperture 60 at the side thereof adjacent the cylinder 54 as viewed in FIG. 8, for exposing the teeth 45 of the pinion 44 to engage the teeth 48 of the piston 50. The piston 50 is thus reciprocally driven in response to the rotation of the pinion 44, to define substantially a rack-and-pinion arrangement. A spring assembly designated generally 62 is mounted within the cylinder 54 to urge the piston 50 in a predetermined direction. This urging also tends to rotate the pinion 44 in a corresponding direction which will in turn drive the linkage assembly 20 in a direction for closing the door, in the absence of any force applied to the door to resist closing.

Figure 10:
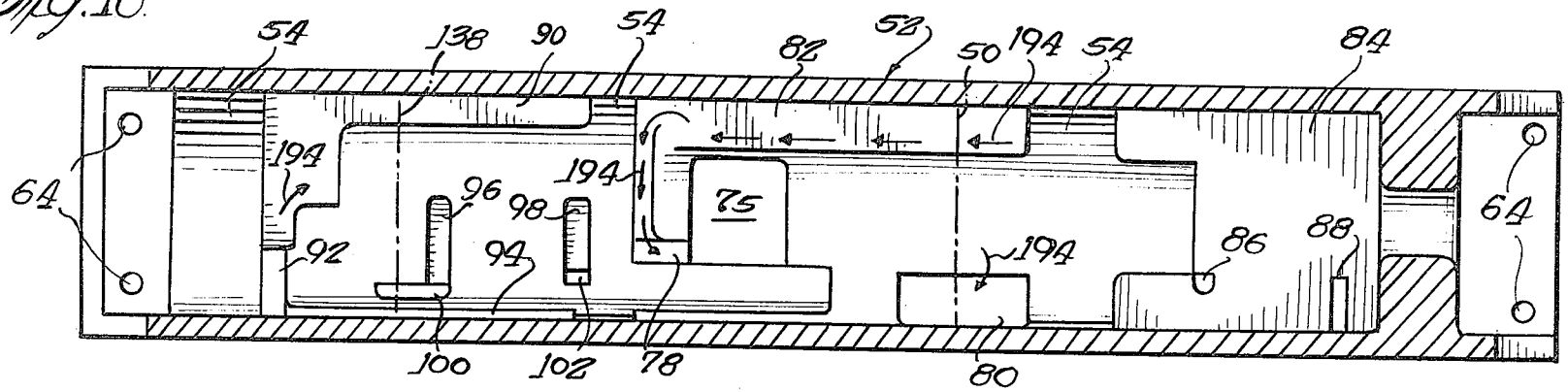
FIG. 10 is a view taken generally along the line 10—10 of FIG. 8.

The closer drive assembly 18 will now be described in detail, with reference directed generally to FIGS. 6 through 10. The closer drive assembly 18 includes the housing 52 which defines a substantially rectilinear exterior surface. Outwardly extending, apertured ears or flanges 64 are provided at a bottom surface of the housing 52, as best seen in FIGS. 8 and 10, for receiving suitable mounting screws or the like to affix the housing 52 to the door frame 12 or the door 14, as desired. Suitable end covering plates 66 are removably engageable with opposite sides of the housing 52 to impart an attractive exterior appearance thereto when mounted on the door or door frame as described.

In the preferred embodiment illustrated herein, the housing 52 comprises a casting arranged for receiving the other components of the closer drive assembly 18 in cooperative fashion. Advantageously the housing 52 is arranged so as to minimize the size, weight and cost of the closer drive assembly 18. Specifically, the housing 52 is cast in a mold (not shown) having a substantially diagonal parting line, as illustrated by the line 67 of FIG. 6, whereby suitable cored cylindrical passageway or bores 68, 70 for receiving a pair of valves 72, 74, to be described later, are formed substantially symmetrically about the parting line 67 to one edge of the housing 52. This structure advantageously minimizes the amount of metal required in the casting to reduce the weight thereof, as the remainder of the bottom portion of the housing 52, is cored out so as to be left substantially hollow. Also, bringing the substantially cylindrical valve receiving passageways or bores 68, 70 to one edge substantially eliminates problems of porosity of the casting which may be encountered in situations requiring coring such openings located centrally in the casting.

The elongate, substantially cylindrical opening 54 is cored centrally in the upper portion of the cast housing 52, above and substantially separated from and parallel to the valve receiving bores 68 and 70. This cylinder 54 receives the piston 50 as described above and the housing 52 is then filled with a fluid such as oil or the like. This arrangement allows hydraulic control of the door movement to be established by controlling the movement of such fluid or oil between opposite sides of the piston 50 within the housing 52. To this end, the housing 52 is cast with a plurality of grooves or channels and ports or apertures communicating between the valve openings 68 and 70 and the cylinder 54 so as to define a plurality of flow paths for the oil or other fluid during opening, closing, and latching of the associated door. The provision of multiple fluid flow paths permits independent control, the operation of which will be described later, of opening rate, closing rate, latching rate and a back check function, respectively.

Figure 11:
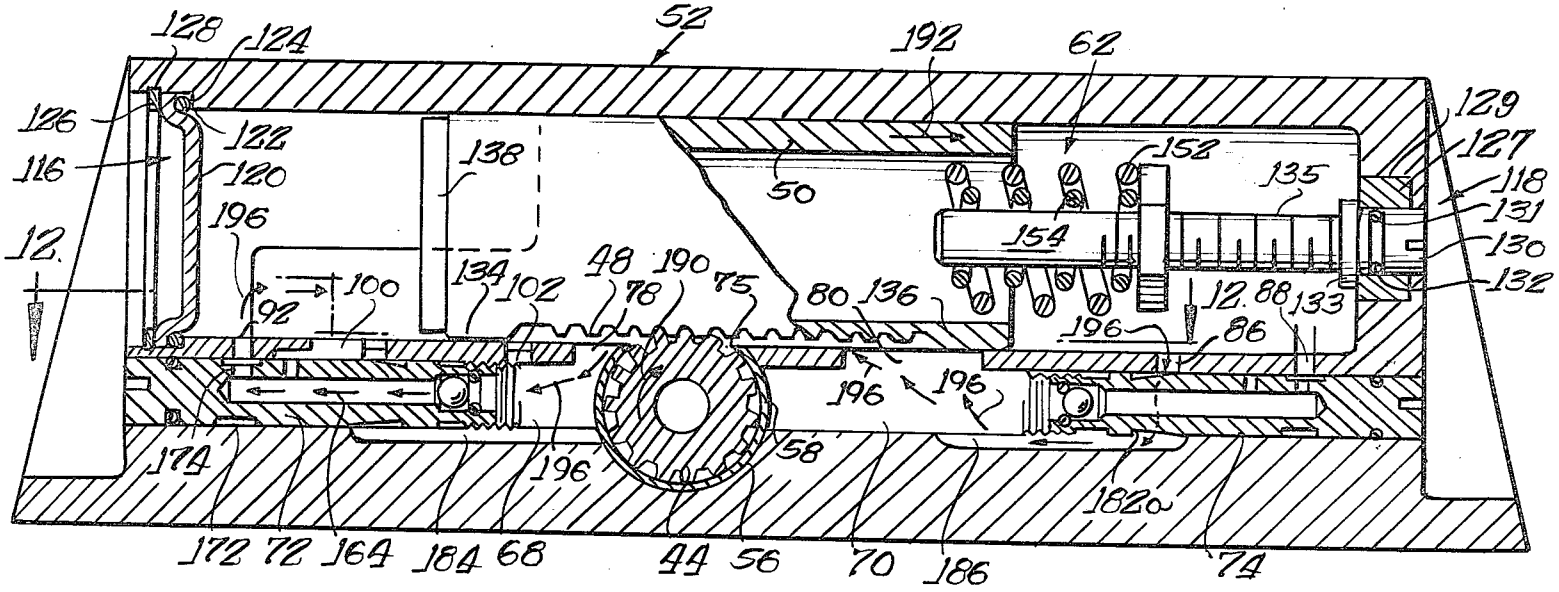
FIG. 11 is a sectional view similar to FIG. 8 and partially broken away illustrating a portion of the operation of the door closer of this invention.

Specifically, it will be seen with reference to FIGS. 10 and 11 that a substantially central window or opening 75 is provided in the housing casting 52 between the cylinder 54 and the pinion receiving bore 56. A second window or opening 80 is provided to one side of the window 75. The window 75 communicates with a further window or opening 78 on the opposite side thereof. The windows 78 and 80 communicate with the valve conduits 68 and 70, respectively. An "L"-shaped channel 82 is set apart from two sides of the opening 75, substantially parallel therewith, and extends from the window 78 to a point substantially opposite the opening 80. A channel 84 forms the right hand side of the cylinder 54, as viewed in FIG. 10 and communicates via a port or opening 86 and a port or opening 88 with the valve receiving bore 70 therebelow. An "L"-shaped channel 90 oriented similarly to the channel 82, and spaced apart to the left somewhat, as viewed in FIG. 10, communicates via a port or opening 92 with the valve conduit 68 therebelow. A channel 94 entends from the opening 92 inwardly, to the same extent and substantially opposite the lateral or side portion of the channel 90, as viewed in FIG. 10. A pair of relatively short, parallel channels 96 and 98 are spaced apart substantially midway between the openings 92 and 75 and and at right angles to the channel 94. The channels 96 and 98 terminate in a pair of cored ports or openings 100 and 102 extending through to the valve receiving bore 68 therebelow. It will be noted that the channels and openings thus described are cored along the parting line 67 in the casting process forming the housing 52 so as to economically provide corresponding fluid flow paths, without requiring additional machining operations. In contrast, the surfaces of the cylinder 54 apart from the channels and openings are arranged so as to have intimate contact with the piston 50 to provide a seal therewith against such fluid flow. Advantageously, the cylinder 54 surfaces which contact the piston 50 and the cylindrical bores 68, 70 for receiving the valves 72, 74 are initially cored in the casting for a somewhat smaller diameter than the outer diameter of the respective piston 50 and valves 72, 74. In accordance with a feature of the invention, then, a minimal amount of machining operations are required following the initial casting in order to complete the housing 52. Specifically, relatively simple reaming operations form the finished interior surfaces of the cylinder 54 and the valve bores 68 and 70 for receiving the piston 50 and valves 72, 74, respectively. Also, since such machining is referenced to internal surfaces, a surprising amount of core shift in the casting operation may be tolerated without effecting the performance of the finished housing 52 when assembled with the other parts.

Referring now to FIGS. 4 and 5, the hold-open assembly 27, initially seen in FIG. 2, is mounted for rotation in unison with the pinion 44. As illustrated in FIG. 2, the hold-open assembly 27 is positioned at the opposite side of the closer assembly 18 from the arm 20 and drive member 22. The hold-open assembly 27 includes a drive member 104 substantially similar to the drive member 22 associated with the arm 20, and engageable with an internally splined socket 105 in the pinion 44, substantially similar to and coaxial with the socket 42 previously described. The drive member 104 also includes a spacer portion 106 to hold a flat spring like member 108 a similar distance from the bottom surface of the closer assembly 18 as the spacing of the arm 20 at the top. Accordingly, the linkage assembly 16 and hold-open assembly 27 are interchangeable with respect to the pinion 44, so as to allow mounting of either at the top or bottom of the closer drive assembly 18, as desired in a particular application. A suitable fastener such as a screw 109 engages the spring 108 with the shaft 104 and spacer 106 and extends through the shaft 104 to threadably engage the internal thread 46 of the pinion 44 and hold the assembly 27 in place. The flat spring like member 108 includes a "starred" aperture 110 therethrough so as to be selectively mountable on the square end of the drive member 104 at a plurality of angular orientations. Similarly, the splined driveshaft 104 is positionable at variable angular orientations, as determined by the number of its splines, with respect to the pinion 44, whereby the flat spring member 108 is positionable at a plurality of angular orientations with respect to the pinion 44. The flat spring member 108 includes a generally circular aperture 112 at the end thereof remote from the drive 104, adapted to engage a stop member 114 directly threadably engaged in the wall of the assembly 18. Consequently, the height of the stop member 114 is adjustable with respect to the assembly 18 thereby providing an adjustment for the amount of lateral force applied thereby at the aperture 112 of the spring member 108 for holding the member 108 in engagement therewith, to hold the door 14 open, at a desired position.

Referring generally to FIGS. 6 through 11, additional structural features of the cooperating housing 52, piston 50, pinion 44, spring assembly 62, and valves 72, 74 will be described. Initially, it will be noted that the housing 52 includes end closures designated generally 116 and 118 at the ends of the cylinder 54 as best seen in FIGS. 8 and 11. The end closure 116 comprises a generally circular plug member 120 which is seated against a flexible O-ring 122. A countersunk shoulder portion 124 is provided at the end of the housing 52 to receive the O-ring 122 and closure plug 120. A snap fing 126 is engaged with an undercut groove portion 128, of somewhat greater diameter than the shoulder 124, thereby holding the plug member 120 in firm engagement with the O-ring 122 to effectively seal this end of the cylinder 54.

The closure 118 at the opposite end of the cylinder 54 comprises a generally circular bearing member 127 which is preferably press-fitted into a generally circular opening 129, so as to seal the cylinder 54 against oil leakage. The opening 129 is of substantially smaller diameter than the cylinder 54. A spring-loading screw member 130, which cooperates with the spring assembly 62, as will be described later, is rotatably seated within the bearing 127 and has a groove 131 which receives an O-ring 132 for effecting sealing at this end of the cylinder 54. From the foregoing, it will be seen that the housing casting may be inexpensively finished by a relatively simple stepped reaming operation with respect to the cylinder and end closures, reaming of the pinion bore, and reaming and tapping of the valve conduits or bores.

In accordance with another feature of this invention, the piston 50 comprises an open-ended tubular member of predetermined length and wall thickness. As best seen in FIGS. 8 and 11, the piston teeth 48 are aligned along one external surface of the piston 50 and are flattened at their outer surfaces to present a somewhat smaller outer periphery than cylindrical end portions 134, 136 of the cylindrical piston 50 to either side of the teeth 48. An end wall closure member 138 is provided for one end of the tubular piston 50 which comprises a substantially circular plug member. A shoulder 140 is provided at the end of the piston 50 for receiving the plug member 138. Advantageously, the plug member 138 comprises a copper-filled, sintered powdered metal member which is press fitted with the shoulder 140, and brazed as indicated by reference numeral 141 to form a seal and a strong mechanical bond therewith for the end of the piston 50.

As best seen in FIGS. 6 and 7, the pinion 44 also includes an end portion 144 extending outwardly of and being of substantially smaller diameter than the teeth 45. The portion 144 rotatably engages an end portion 146 of the bushing member 58 of similar internal diameter. The portion 146 also defines an interior shoulder for axially positioning the pinion member 44 for engagement between the teeth 45 and the teeth 48 of the piston 50. The pinion portion 144 and bearing portion 146 include respective undercut groove portions, 148 and 150, which are axially spaced apart when the pinion 44 is assembled with the bushing 58. Advantageously, a flexible O-ring 149 is inserted in the undercut channel 150 to provide a fluid seal at the pinion end 144. The bushing 58 is press fitted in the cylindrical bore 56 and also locked in place by the outside diameter of piston 50 protruding into cutout 60 of the bushing 58. This effectively seals the housing 52 for retaining fluid or oil for hydraulic operation. Also, a snap ring 151 and a flexible O-ring 153 abut the respective ends of the bushing 58. The O-ring 153 seats in an internal groove in the bore 56 and engages the outer periphery of an adjacent end of the pinion 44 to form a seal. The snap ring 151 engages the groove 150 to axially retain the pinion 44. Advantageously, the teeth 45 are formed integrally with a main body portion **44*a* of the pinion 44, thus optimizing the strength of the teeth 45 relative to their size. This feature allows some size reduction in the pinion 44 and in the closer drive assembly 18. Moreover, the teeth 45 and body portion 44*a* are of equal outer diameter, thus maximizing the bearing surface of the pinion 44 with respect to the bushing 58. In accordance with a feature of this invention, the bushing 58 and pinion 44** comprise a copper-filled sintered powdered metal construction, thus presenting accurate, close-tolerance dimensions and, low friction bearing surfaces.

As best seen in FIG. 8, the spring assembly 62 comprises a first or outer spring member 152 and a second or inner spring member 154 of somewhat lesser axial and radial dimensions. Preferably, the spring members 152 and 154 comprise substantially round compression springs. The load screw 130 is axially retained by an integral shoulder portion 133 so that its threaded shank 135 extends generally coaxially within the springs 152 and 154. In accordance with a feature of the invention, an internally threaded stop member or nut 156 is engaged with the threaded shank 135 and abuts one end of each of the springs 152 and 154. Consequently, the stop member 156 may be selectively advanced or retarded along the shank 135, responsive to rotation of the load screw 130 within the bearing 126, to adjust the amount of force exerted by the spring assembly 62 against the end wall 138 of the piston 50. Specifically, the longer spring 152 may be positioned by the stop member 156 to engage the end wall 138 of the piston 50, when the piston is at the position illustrated in FIG. 8, for example. At this same piston position, however, the shorter spring 154 will not be in engagement with the end wall 138. Accordingly, the stop member 156 may be adjusted by rotation of the load screw 130 to bring the springs 152 and 154 independently into engagement with the end wall 138 at selected intervals during the reciprocal motion of the piston 50. The spring assembly 62, together with the load screw 130 and stop member 156, thus provides a selectively adjustable amount of force for urging the piston 50 in a predetermined direction, which corresponds generally to the closing of the associated door 14. Similarly, this adjustable amount of force resists the opening of the associated door 14. There is therefore provided a relatively wide range of adjustment for accommodating a considerable variety of door weights and sizes and loads. Moreover, it will be appreciated that selective angular positioning of the splined driveshaft 22 of the arm 20 with respect to the internally splined socket or opening 42 of the pinion 44 allows for some amount of preloading on the spring assembly 62. Specifically, by adjusting the relative angular position of the arm 20, drive 22 and socket 42 prior to assembling the linkage assembly 16 with the door or door frame, the pinion 44 may be rotated somewhat to accomplish a selected amount of compression in the spring assembly 62, even with the door 14 fully closed. This then further broadens the range of door weights and sizes and loads which may be accommodated by the door closer apparatus of this invention.

Reference is now directed to FIGS. 8 and 9 for further description of the valves 72 and 74 and valve receiving bores 68 and 70 of the housing 52. It will be noted that the valves 72 and 74 are identical, whereby description of the valve 72 applies to both.

The valve 72 comprises a generally cylindrical body rotatably received in the valve receiving bore 68. An end or nose portion 158 of the valve 72 is externally threaded for threadably engaging a complimentarily internally threaded portion 160 at the inner part of the valve receiving opening 68. The valve receiving opening 70 has a similar internally threaded portion 162. These threaded valve and valve receiving portions cooperate to permit some degree of axial movement of the valves 72 and 74 within their respective valve receiving bores 68 and 70. The valve 72 has an internal flow channel or chamber 164 which extends through the threaded nose 158. An undercut internal groove in the nose portion 158 receives a flexible O-ring 166. The O-ring 166 forms a valve seat for a ball 168 which is moveable within the limits of a ball chamber 170 of enlarged diameter formed in the channel 164. Advantageously, the flexible O-ring tends to discard debris, metal chips or in cooperation with the ball 168 to define an effective and reliable check valve.

In accordance with a feature of the invention, the outer surface of the cylindrical valve 72 is conformed so as to cooperate with the openings 92, 100, and 102 of the housing 52 to provide several fluid flow paths which come into play at different stages of the operation of the door closer assembly. Specifically, a first circumferential exterior groove or channel 172 in the valve 72 is so positioned and of sufficient width as to be in communication with the channel 92 throughout the range of axial movement of the valve 72 with respect to the threads 160. A port 174 within the channel 172 communicates with the interior valve chamber 164. A second port 176 in the valve 72 communicates with the chamber 164 and with an internal, eccentric groove or undercut channel portion 180 of the valve receiving bore 68 which extends substantially half-way there around as best seen in FIG. 9. Consequently, as the valve 72 is rotated within the bore 68 the port 176 will be in communication with the eccentric groove 180 over substantially half of the 360° of rotation thereof. The groove 180 communicates with the port or opening 100. A generally wedge-shaped groove or channel 182 gradually increasing in diameter toward the nose 158 is formed on the body of the valve 72. The axial extent of the groove 182 is such that at least some portion thereof remains in communication with the port or opening 100 of the housing 52 throughout the axial movement of the valve 72 with respect to threads 160. As will be more fully described hereinbelow, axial movement of the valve 72 to vary the proportion of the groove or channel 182 in communication with the port or opening 100 provides a fluid flow rate control therethrough. The housing 52 also includes an elongate axially extending channel 184 below the valve 72 so as to provide a communicating channel between the groove or channel 182 and the window or opening 78 of the housing 52 at all times. A similar channel 186 is formed in the housing with respect to the valve receiving bore 70 and valve 74. With respect to the valve 74 it will be noted that a groove or channel 172*a* similar to the groove 172 communicates with the port or opening 88 of the housing 52, and a groove or channel 182*a* similar to the groove 182 communicates with the port or opening 86, and with the channel 186, which communicates with the port or opening 80. An external circumferential groove 185 in the valve 72 receives a flexible O-ring 187, axially outwardly of the groove 172, to rotatably seal the valve 72 with respect to the valve receiving bore 68.

Having described the structural features of the present invention, it will be instructive at this juncture to describe the operation of the closer drive assembly 18.

Referring initially to FIGS. 8 and 10, the closer drive assembly 18 is seen during the opening of the associated door 14, wherein the linkage assembly 16 imparts rotary motion to the pinion 44 in the direction of the arrow 190. The pinion 44 actuates the piston via the engaged teeth 45 and 48 in the direction indicated by the arrow 192, such that the end closure 138 engages a portion of the spring assembly 62, which is suitably adjusted by the load screw 130 to impart the desired degree of resistance to the opening of the door 14. It will be appreciated, that in order for the piston 50 to reciprocate in the cylinder 54, a portion of the fluid or oil filling the cylinder 54 must be transferred between opposite sides of the piston 50. Specifically, in this instance, fluid must move from the portion of the cylinder 54 to the right hand side of the piston end wall or closure 138 to the portion of the cylinder 54 to the left hand side thereof, as viewed in FIG. 8. Accordingly, as the piston initially moves in the direction of the arrow 192, it will be seen that a substantial portion of the window or opening 80 is exposed, as well as an end portion of the channel 82, which communicates with the opening 78, whereby fluid is free to flow as indicated generally by the arrows 194 through the windows or openings 78 and 80 towards the nose portion 158 of the valve 72. The pressure exerted upon the fluid by the opening door will open the valve by pushing the ball 168 away from the seat 166 and into the ball chamber 170, allowing flow through the valve chamber 164 and the ports or openings 174 and 176 and the housing ports or openings 92 and 100 to the opposite side of the piston closure 138.

Figure 12:
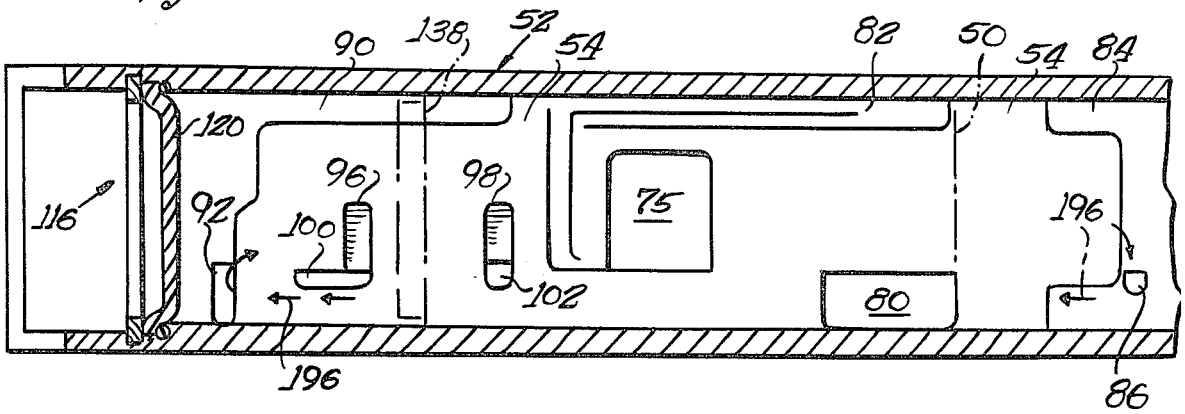
FIG. 12 is a view taken generally along the line 12—12 of FIG. 11.

Referring now to FIGS. 11 and 12, as the piston 50 continues to move in the direction 192 in response to the opening of the door 14, the piston 50 effectively blocks off the channel 82 and the window or opening 80. The fluid flow path, as indicated by arrows 196, is now confined to the port or opening 86 and wedge-shaped groove or channel 182*a* of the valve 74, and thence through the channel 186, whereupon the flow path is through the window 80, and around the piston teeth 48, and thence through the valve 72 as described above with reference to FIGS. 8 and 10. Advantageously, the valve 74 may be threadably advanced or retarded with respect to the threads 162 to define the relative opening available to the fluid between the groove or channel 182*a* and the port or opening 86, thus controlling the overall fluid flow rate within the closer drive 18. This control function, via the rotation of the valve 74, comprises a back check function for the associated door 14. That is to say, the selected size of the fluid flow path thus defined requires a corresponding amount of force for the continued opening of the door in this direction. It will be noted that the spring loading screw 130 may be adjusted so that the stop 156 brings the second or inner spring member 154 into play during this latter portion of the door opening as well, to further aid in providing a back check function, so as to accommodate heavier doors and/or loads.

Figure 13:
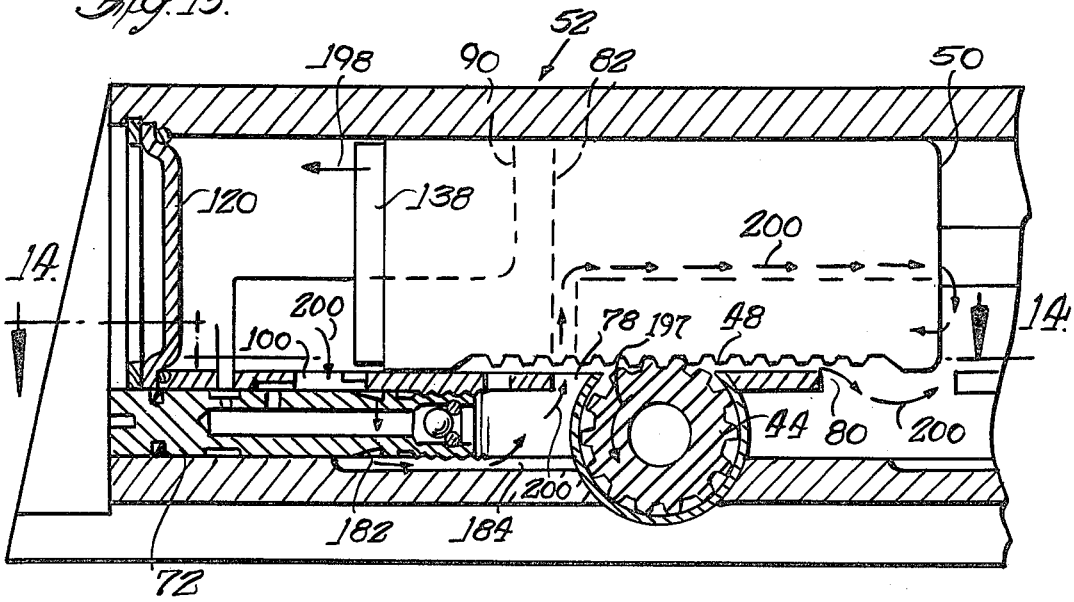
FIG. 13 is a sectional view partially broken away, and similar to FIG. 11 illustrating further portion of the operation of the door closer of this invention.
Figure 14:
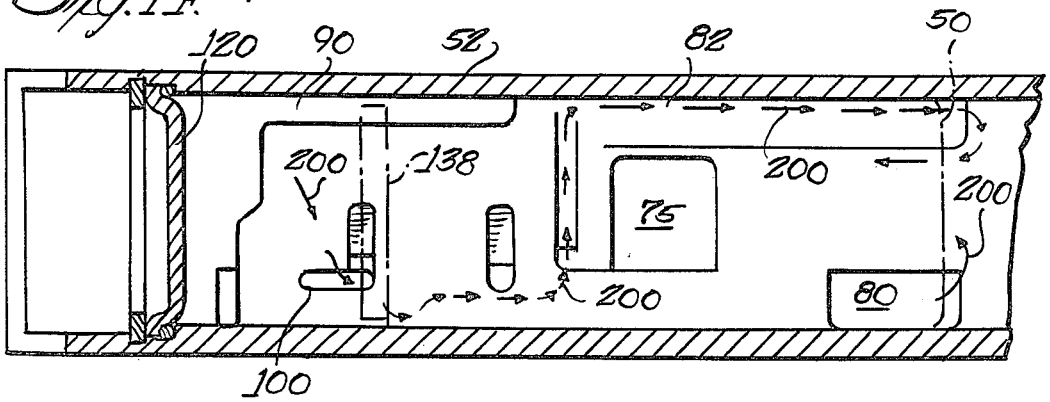
FIG. 14 is a view taken generally along the line 14—14 of FIG. 13.

Referring now to FIGS. 13 and 14, the operation of the closer drive assembly 18 during the closing of the associated door 14 will be described. During closing, it will be appreciated that the linkage assembly 16 rotates the pinion 44 in a direction 197 opposite its direction of rotation 190 during opening. Accordingly the piston 50 will be driven thereby in a direction as indicated by the arrow 198, opposite the direction 192, described previously. Consequently, a fluid flow path must be provided to deliver fluid in the opposite direction, that is from the left hand side of the closure member 138 to the right hand side thereof as viewed in FIGS. 13 and 14. During the initial portion of the closing cycle, the fluid moves generally as indicated by the arrows 200 through the port or opening 100 and around the wedge-shaped groove or channel 182 of the valve 72, to the channel 184, and thence either through the opening 78 and channel 82, or alternatively a relatively small amount around the teeth 48 and through the opening 80, to reach the opposite side of the piston 50. It will be noted, that during the initial portion of the closing cycle, wherein the piston 50 is covering the opening 80 and channel 82, as illustrated in FIGS. 8 and 10, the fluid having reached this point, will be moving in the appropriate direction to open the valve 74, and therefore fluid will flow therethrough and via the port or opening 88 to the opposite side of the piston. The relative axial position of the groove 182 thus provides a closing rate adjustment during this portion of the cycle.

Figure 16:
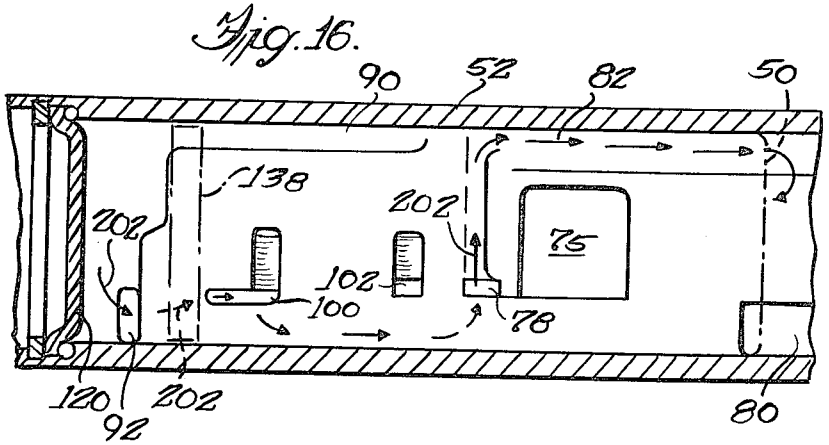
FIG. 16 is a view taken generally along the line 16—16 of FIG. 15.
Figure 18:
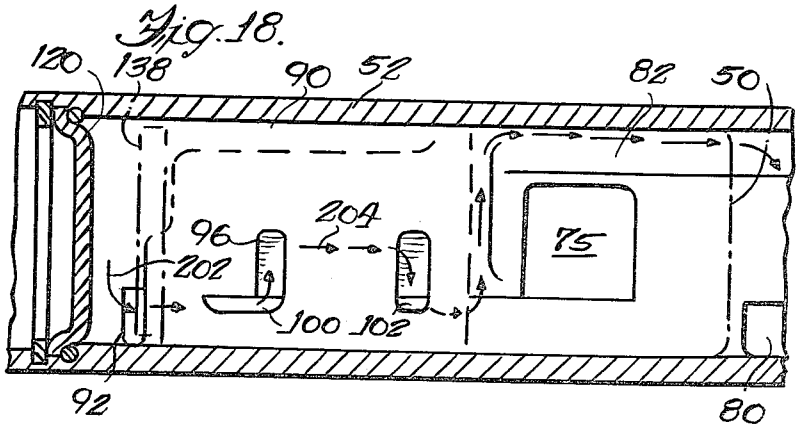
FIG. 18 is a view taken generally along the line 18—18 of FIG. 17.
Figure 15:
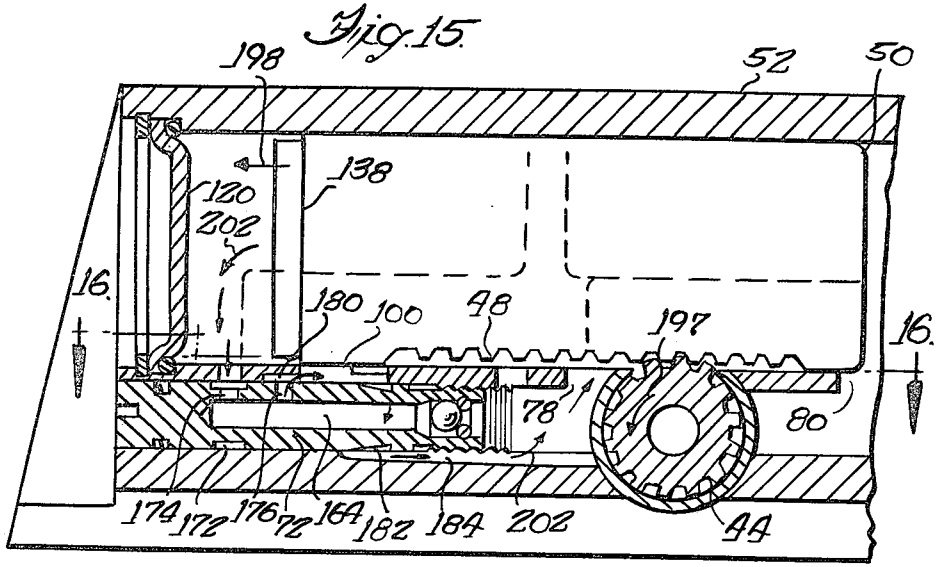
FIG. 15 is a sectional view similar to FIG. 13 illustrating still another portion of the operation of the door closer of this invention.
Figure 17:
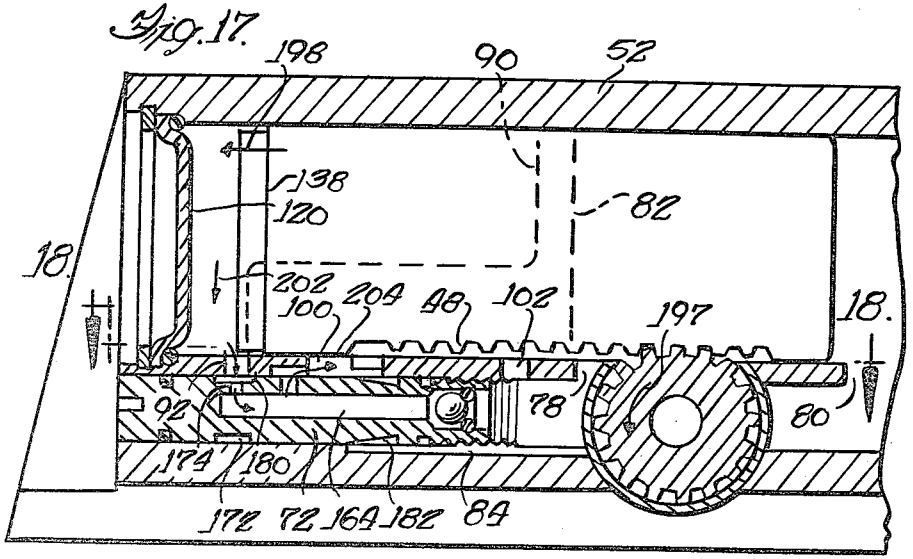
FIG. 17 is a view similar to FIG. 15 illustrating still another portion of the operation of the door closer of this invention.

Referring now to FIGS. 15 and 16 as well as FIGS. 17 and 18, the close to latch transition period and latching period in the action of the closer drive assembly 18 are illustrated, respectively. With respect to FIGS. 15 and 16, it will be noticed that at a point in the closing of the door 14, the piston 50 is moved into a position in which it completely seals off the port or opening 100. Therefore, the fluid must flow in a path indicated by arrows 202, through the port or opening 92 and the port 174 of the valve 72, to the valve port 176 and thence to the eccentric groove 180 and port or opening 100. From the port or opening 100 the fluid flow in FIG. 15 must run through the groove or channel 182 of the valve 72 to the channel 184 to reach the channel 82 and window or opening 80 at the opposite side of the piston 50. In FIGS. 17 and 18, it will be noted that the piston 50 has advanced sufficiently in the direction 198 to expose the port 100. Consequently, fluid may also flow beneath the teeth 48 to reach the channel 82 as indicated by the arrow 204. It will be appreciated from the foregoing, that the position of the valve port or opening 176 with respect to the eccentric groove 180 of the valve receiving opening 68 of the housing 50 will effectively control the rate of fluid flow during the latching portion of the cycle. Specifically, as mentioned above, the channel 180 extends only half-way around the valve receiving bore 68, whereby the valve 72 may be rotated to position the port 176 to gradually decrease rate of fluid flow, and thereby control the latching rate of the door as it approaches its latching position.

What has been shown and described herein is a door closing apparatus including selectively and independently operable means for varying opening force, back check force, latching rate and closing rate of an associated door. Moreover, the described invention provides such independent adjustments while presenting a minimum exterior dimension so as to permit mounting of the apparatus in many applications where limited space is available. The foregoing features are combined in the present invention while maintaining a relatively simple and inexpensive structure for the door closing apparatus which requires relatively few operations in its manufacture and assembly and also minimizes both the cost and weight of the finished door closer assembly.

The specific embodiment herein shown and described is to be considered as being primarily illustrative. Various changes and modifications will, no doubt, occur to those skilled in the art and possessed of the present disclosure; and such changes and modifications will be understood as forming a part of this invention insofar as they fall within the spirit and scope of the appended claims.

The invention is claimed as follows:

1. A door closer apparatus comprising in combination: a housing, means defining a cylinder in said housing and a bore through said housing, a piston mounted for reciprocal motion in said housing cylinder and having a plurality of piston teeth aligned along a portion of its exterior surface, a pinion rotatably mounted in said housing bore and having a plurality of circumferentially disposed pinion teeth for engaging said piston teeth, biasing means for urging said piston in a predetermined direction thereby rotating said pinion in a corresponding direction, linkage means for joining said door closing apparatus between a door and door frame and having a driveshaft member connected to said pinion for rotating said pinion in a direction opposite said first mentioned direction in response to opening of said door and for closing said door in response to rotation of the pinion in said first mentioned direction, respectively, said pinion comprising a generally cylindrical member having a central socket for receiving said driveshaft member, said cylindrical member having a first portion of predetermined outer diameter about said central socket, said circumferentially disposed pinion teeth being formed integrally with and extending axially outwardly of said first portion to define an outer diameter substantially equal to said predetermined outer diameter.

2. A door closer apparatus according to claim 1 wherein said pinion comprises a sintered powdered metal, copper-filled material for obtaining relatively fine tolerances in the dimensions of said teeth, said socket and said first portion thereof and for presenting a relatively low friction bearing surface for rotation in said bore.

3. A door closing apparatus according to claim 2 further including a substantially cylindrical tubular bushing member interposed between said pinion and said bore and including a window portion for permitting said engagement between said piston teeth and said pinion teeth, said bushing member comprising a sintered powdered metal, copper-filled material for obtaining relatively fine tolerance dimensions and for presenting a low friction bearing surface to said pinion.

4. A door closing apparatus according to claim 1, wherein said piston comprises a generally cylindrical tubular member having first and second ends, said piston teeth having a radially outward extent less than the outer diameter of said cylindrical tubular member, a plug member of copper filled, sintered powdered metal, said first end of said piston having a counter-sunk portion for receiving said plug member thereby defining a closed end of said piston and dividing said cylinder into volumetric portions which vary in accordance with the reciprocation of said piston, said closed end abutting at least a portion of said biasing means for urging said piston in said predetermined direction.

5. A door closing apparatus according to claim 1 said housing further including a plurality of fluid passageway means arranged for selectively delivering fluid between the volumetric portions defined at opposite sides of said piston as said piston reciprocates in response to said opening and closing of said door, and fluid flow control means including valve means disposed for cooperation with said fluid passageway means for selectively controlling the rate of fluid flow therethrough and thereby controlling the rate of closing and latching of said door, said valve means including at least one valve member having an elongate generally cylindrical body including inlet means and outlet means, a valve chamber in said body disposed intermediate said inlet means and said outlet means, a valve ball disposed in said valve chamber and moveable therein for selectively allowing and preventing flow between said inlet means and said outlet means, said chamber including a valve seat comprising a circumferential interior groove in said valve chamber and a flexible O-ring disposed in said groove.

6. A door closing apparatus according to claim 5 wherein said housing comprises a casting member including said cylinder cast therein, a bore cast therethrough substantially perpendicular with said cylinder for receiving said pinion, said cylinder and said bore intersecting over a predetermined fractional portion of the respective volumes thereof, and valve receiving bore means cast in said casting member and having internally threaded portions for engaging said valve means, said fluid flow means including cast port means and channel means for selectively allowing the flow of a fluid between selected portions of said first cylinder and said valve receiving bores and including an eccentric groove circumferentially disposed about a portion of said valve receiving bore means for cooperating with said valve means therein to control the rate of fluid flow therethrough.

7. A door closing apparatus according to claim 6 wherein said casting member has upper and lower portions and is cast about a substantially diagonal parting line, said cylinder is disposed substantially centrally and in said upper portion, said valve receiving bore means comprises a generally cylindrical opening through said lower portion substantially parallel with said cylinder and symmetrical about said diagonal parting line.

8. A door closing apparatus according to claim 7 wherein said valve means comprises a pair of said valve members, said cylindrical bodies having externally threaded nose portions for engaging said internally threaded portion of said valve receiving bore means for rotation and axial movement of said valve members with respect to said bore means, and each of said cylindrical valve bodies including a first circumferential external groove of a given diameter, smaller than the diameter of said cylindrical body and communicating with one of said inlet means, and with a selected one of said port means of said housing, each of said valve bodies further including a generally wedge-shaped, circumferential external groove member defining a gradually decreasing diameter with respect to the diameter of said cylindrical body, said wedge-shaped grooves each cooperating with another of said port means of said housing for controlling the rate of said fluid flow between selected portions of said housing, in accordance with the axial position of said valve members with respect to said port means.

9. A door closing apparatus according to claim 8 wherein one of said inlet means of one of said valve members is axially disposed and radially movable with the valve member for selectively communicating with said eccentric groove.

10. A door closing apparatus comprising: a housing, means defining a cylinder in said housing, a piston mounted for reciprocation in said cylinder and having a plurality of piston teeth formed thereon, a pinion mounted for rotation in said housing and having a plurality of circumferentially disposed pinion teeth engaging said piston teeth to actuate said piston in response to rotation of said pinion, linkage means for joining said door closing apparatus between a door and a door frame and including drive means engaging said pinion for rotating said pinion in response to opening and closing of said door, respectively, said piston comprising a tubular member having a closed end and an open end and biasing means for urging said piston in a predetermined direction, said biasing means comprising a first compression spring member and a second compression spring member of shorter uncompressed axial length than the first compression spring member and coaxially disposed in said piston therewith, an axially moveable stop member abutting an end of said first and second spring members remote from the closed end of said piston member and means for axially varying the position of said stop member for effecting a desired amount of compression of said first spring member against said piston member closed end and for selectively advancing said second spring member to effect either none or a desired degree of compression against said piston member closed end over the travel thereof during reciprocation, thereby providing means for selectively adjusting the biasing force supplied by said biasing means for urging said piston in said predetermined direction.

11. A door closing apparatus comprising a housing having a cylinder therein, a piston mounted for reciprocation in said cylinder, a pinion mounted for rotation in said housing, cooperating means on said pinion and said piston for effecting reciprocation of said piston in response to rotation of said pinion, means biasing said piston in a predetermined direction, linkage means for joining said door closing apparatus between a door and a door frame and connected with said pinion for rotating said pinion bidirectionally in response to opening and closing of said door respectively, and means for stopping the rotation of said pinion at a selectable point during said opening of said door to hold said door open at said selected point, said last mentioned means comprising drive means engaged with said pinion for rotation in unison therewith, a flat, elongate resilient member having first and second ends, said first end including means selectively positionable with respect to said drive means for effecting a plurality of angular orientations of said elongate member with respect to said drive means, and stop means extending outwardly of said housing at a radial distance from said drive means less than the length of said elongate member, said elongate member further including means at said second end thereof for releasably engaging said stop means.

12. A door closing apparatus comprising a housing, a piston and a pinion mounted in said housing for reciprocation and rotation respectively, cooperating means on said piston and said pinion for reciprocating said piston in response to rotation of said pinion, and linkage means for joining said door closing apparatus between a door and a door frame, and comprising first and second elongate arm members, said first arm member having driveshaft means at one end thereof for engaging said pinion for rotation in unison therewith, and said second arm member having first and second ends and means in said first end defining substantially a ball joint for pivotally engaging an end of said first arm member opposite said driveshaft means, and means defining another ball joint at said second end for pivotal engagement with a mounting bracket to complete said joining of said apparatus between said door and frame, said last two mentioned means comprising through apertures in said first and second ends of said second arm member, each of said apertures defining an annular interior surface comprising a section of a sphere, and a pair of bearing members each having spherical external surface portions removeably engageable with said interior spherical surfaces, said bearing members having central openings for receiving a fastener therethrough to effect said pivotal engagement while retaining said bearing members in said openings.

13. A door closing apparatus comprising in combination: a housing comprising a casting member having a cylinder cored therein and a bore cored therethrough substantially perpendicular with said cylinder and intersecting said cylinder over a predetermined fractional portion of the volume thereof, a cylindrical piston mounted for reciprocal motion in said cylinder, a pinion rotatably mounted in said bore, cooperating teeth on said piston and said pinion engaged through said intersecting portions of said bore and cylinder for effecting reciprocation and rotation of said piston and pinion in unison, a bushing member interposed between said pinion and said bore and having a window disposed for permitting said engagement between said cooperating teeth, linkage means for joining said door closing apparatus between a door and a door frame and including first and second elongate arm members, said first arm member having driveshaft engaging said pinion and said second arm member having first and second ends, means in said first end defining substantially a ball joint for pivotally engaging an end of said first arm member opposite said drive shaft means, means defining a second ball joint in said second end for pivotal engagement with a mounting bracket to complete said joining between said door and door frame, means defining a closed end of said piston for dividing said cylinder into portions of varying volume in accordance with the reciprocation of said piston, and biasing means for urging said piston in a predetermined direction and comprising a pair of coaxially disposed compression spring members disposed in said cylinder and an axially movable stop member abutting one end of said pair of spring members, an opposite end of said pair of spring members abutting said closed end of said piston, said stop member effecting a desired amount of compression of first and second spring members in accordance with the axial position thereof, said housing being adapted for retaining a predetermined amount of fluid such as hydraulic oil therein, said door closing apparatus further including fluid flow control means comprising a plurality of port means and channel means in said housing, and valve means cooperating with said port means and channel means for selectively controlling fluid flow between opposite sides of said piston in response to opening and closing of said door, respectively.

* * * * *